US005440638A

United States Patent [19]

Lowe et al.

[11] Patent Number: 5,440,638

[45] Date of Patent: Aug. 8, 1995

[54] STEREO ENHANCEMENT SYSTEM

[75] Inventors: Danny D. Lowe; Scott Willing; William Gonnason; Mark Williams, all of Calgary, Canada

[73] Assignee: Q Sound Ltd., Calgary, Canada

[21] Appl. No.: 115,577

[22] Filed: Sep. 3, 1993

[51] Int. Cl.[6] ..... H04S 5/00

[52] U.S. Cl. ..... 381/17; 381/1

[58] Field of Search ..... 381/1, 17

[56] References Cited

U.S. PATENT DOCUMENTS 4,355,203 10/1982 Cohen ..... 381/1

4,980,914 12/1990 Kunugi et al. ..... 381/1

5,305,386 4/1994 Yamato ..... 381/17

*Primary Examiner*—Forester W. Isen

*Attorney, Agent, or Firm*—Jay H. Maioli

[57] ABSTRACT

The sound field in a stereo reproduction system is enhanced by a preprocessor that removes a portion of the audio information that is common or substantially common to both the left and right stereo input signals before processing the signals in left and right sound placement filters. The left and right placement filter output signals, from which a portion of the common audio information was previously removed before processing, are added to the right and left stereo input signals, respectively, to produce enhanced sound field stereo output signals. The input signals that do not undergo placement processing are delayed in delay filters so that coherency is maintained when the signals are added and both the placement filters and the delay filters can be implemented by a series of cascaded bi-quadratic filters.

14 Claims, 5 Drawing Sheets

STEREO ENHANCEMENT SYSTEM

BACKGROUND OF THE INVENTION

1. Field of the Invention

This invention relates generally to a method and apparatus for enhancing the effects of a stereophonic audio reproduction system and, more particularly, to a method and apparatus for processing stereo signals to enhance the sound field provided in stereo reproduction.

2. Description of the Background

There are now well known numerous systems that are intended to process stereophonic signals during playback in an effort to improve the stereophonic effects that are available. For example, some systems are intended to improve the stereo separation or to place the apparent source of the sounds at locations other than the actual location of the loudspeaker. One system for stereo processing would apply the left channel signal to a specialized left-placement filter and then apply the right channel signal to a right-placement filter. The left input signal and the output of the right-placement filter would be added to form the left channel and the right input channel would be added to the output of the left-placement filter to form the right channel. Such a system can provide some improved stereo effects over a conventional stereo playback system.

On the other hand, normal stereo program material has information that is common to both channels. Thus, in an unprocessed stereo playback system using two loudspeakers this common program information would appear in the center of the stereophonic sound field. It is this common information, or information that is substantially the same in both channels, that when processed according to a system such as described above will result in a general lack of information in and at the center of the sound field. This is so because such common audio information is being simultaneously processed in both the left-placement filter and in the right-placement filter. Thus, the sounds are generally diminished relative to that common material and it has been found that due to such cancellation there is a decrease in the low-frequency information in the processed or so-called enhanced stereo output signals.

OBJECTS AND SUMMARY OF THE INVENTION

Accordingly, it is an object of the present invention to provide a method and apparatus for enhancing the sound field of stereo playback signals that can eliminate the above-noted defects inherent in the previously proposed systems.

Another object of this invention is to provide a method and apparatus for stereo enhancement in which the common information in stereophonic signals is not processed in sound placement filters, so as to provide a more even and expansive stereophonic sound field.

A further object of the present invention is to provide a method and apparatus for stereophonic enhancement in which a pre-processor is provided to prevent a portion of the common information of the left and right stereo signals from being processed or filtered and which adjusts amplitudes and time delays in the left and right channels so that an enhanced stereophonic sound field is provided.

According to an aspect of the present invention, a pre-processor is provided for insertion between a signal source, such as the audio pre-amplifier output stage of a stereo system and the final power amplifier stage. In such pre-processor, all or just a portion of the common information is deleted or subtracted from the signal before being processed for left and right placement. The placement filter output signals are then combined with the respective input signals to produce the left and right stereo output signals having enhanced stereo effects.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

According to an embodiment of the present invention a front-end preprocessor is provided to a system typically employing left and right placement filters, which preprocessor prevents common information and so-called mono-signals from being processed. Thus, the placement filters operate solely on the true stereo signals and the common program material passes through the system unfiltered. Because various signals in a stereo program are frequently placed neither at the right or left channel and are frequently completely monaural or consisting of entirely common material, the effect of the present invention will be to spread the unprocessed stereo signals proportionately across a wider stereophonic sound field.

Figure 1:
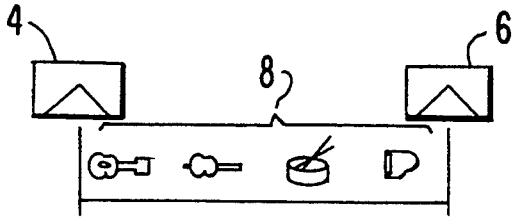
FIG. 1 is a pictorial representation showing conventional stereo sound imaging.

FIG. 1 represents a typical stereo sound field or sound image, in which a listener 2 who is positioned in front of two loudspeakers 4 and 6 perceives the musical instruments, shown generally at 8, to be spread across a sound stage extending between the left and right loudspeakers 4 and 6. While this sound field of FIG. 1 can be generally acceptable, the present invention seeks to enhance the stereo image and broaden the sound stage.

Figure 2:
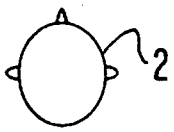
Fig. 2 is a pictorial representation showing enhanced stereo imaging provided by an embodiment of the present invention.
Figure 2:
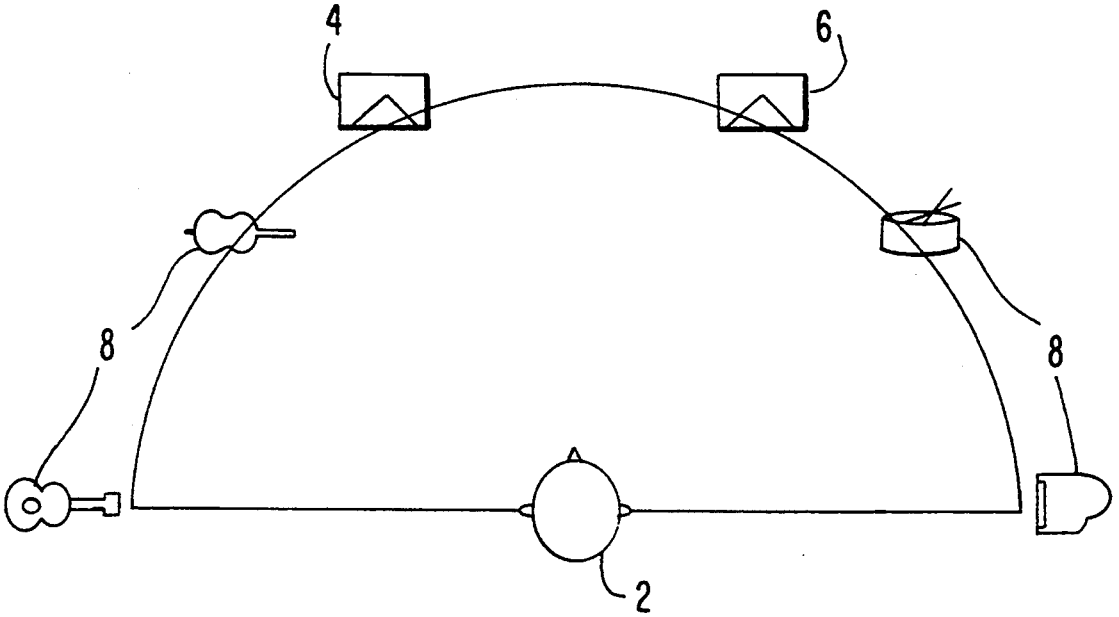

FIG. 2 represents an enhanced stereo image that is much more enjoyable to the listener 2, as well as being more realistic. In this enhanced stereo sound field the instruments 8 can appear at locations beyond the locations of the loudspeakers 4 and 6. That is, the sound stage extends not only beyond the actual locations of the loudspeakers from side to side but, also, an added depth perception is provided so that the actual placement of the various instruments on the stage, for example, can be discerned by the listener 2.

Figure 3:
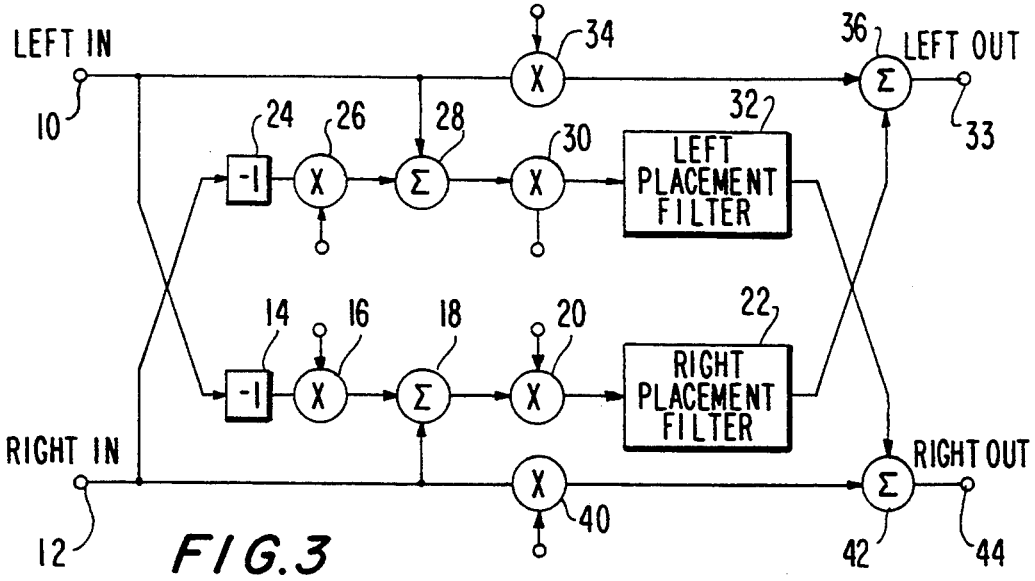
FIG. 3 is a schematic in block diagram form of a stereo enhancement system according to an embodiment of the present invention.

A system to accomplish this sound field widening or enhancement is shown in FIG. 3. Conventional left and right stereo signals, which are at the line level such as nominally one volt as might be produced by a preamplifier section to the main power amplifier section, are fed in at input terminals 10 and 12, respectively. In this system, it will be appreciated that the signal fed to the respective left and right side placement filters is a true stereo signal or difference signal that has a portion of the common information removed. More specifically, the stereo left channel signal fed at in input terminal 10 is passed through an inverter 14 and fed to a controllable attenuator 16. The output of attenuator 16 is fed to one input of a signal summing circuit 18. The other input to signal summing circuit 18 is the right channel signal fed in at terminal 12. Therefore, because the left channel is inverted and fed to the summing circuit 18, the output of summing circuit 18 is effectively the difference between the right and left channels. This signal is fed through a controllable attenuator 20 whose output is then fed to the right placement filter 22. Similarly, the right channel signal fed in at terminal 12 is passed through an invertor 24 to a controllable attenuator 26. The output of the attenuator comprises one input to a signal summing circuit 28 with the other input consisting of the left channel signal fed in at input 10. The output then of the signal summing circuit 28 represents the left channel signal with the right channel subtracted therefrom. That difference signal is fed through a controllable attenuator 30 whose output then is the input to the left-placement filter 32. The left-channel signal fed in at terminal 10 can be level adjusted in controllable attenuator 34 and the output fed to one input of a signal summing circuit 36. The other input of signal summer 36 is the output of the rightplacement filter 22, so that the output of summer 36 becomes the stereo enhanced left channel output signal available at terminal 38. Similarly, the right channel signal fed in at input 12 is passed through a controllable attenuator 40 whose output becomes one input to a signal summing circuit 42. The other input to the signal summer 42 is the output of the left-placement filter 32. The output of the signal summer 42 is available at terminal 44 and represents the stereo enhanced right channel signal.

It will be appreciated initially from the embodiment of FIG. 3 that, since the two channels are effectively subtracted from each other before being fed to the respective placement filter, if the signals are equal no placement filtering takes place at all and the true stereo signals are fed to the respective left and right output terminals 38 and 44.

In the embodiment of FIG. 3, the attenuators 16, 20, 26, 30, 34, and 40 are so-called controllable attenuators. These attenuators all have a control input so that the extent of their attenuation can readily be controlled. Such control may consist of an initial setting in which the input to the attenuators would be represented by a constant K, or the control can be a continuous and ongoing variable and may be controlled by a microprocessor or the like to achieve various degrees of stereo enhancement.

Figure 4:
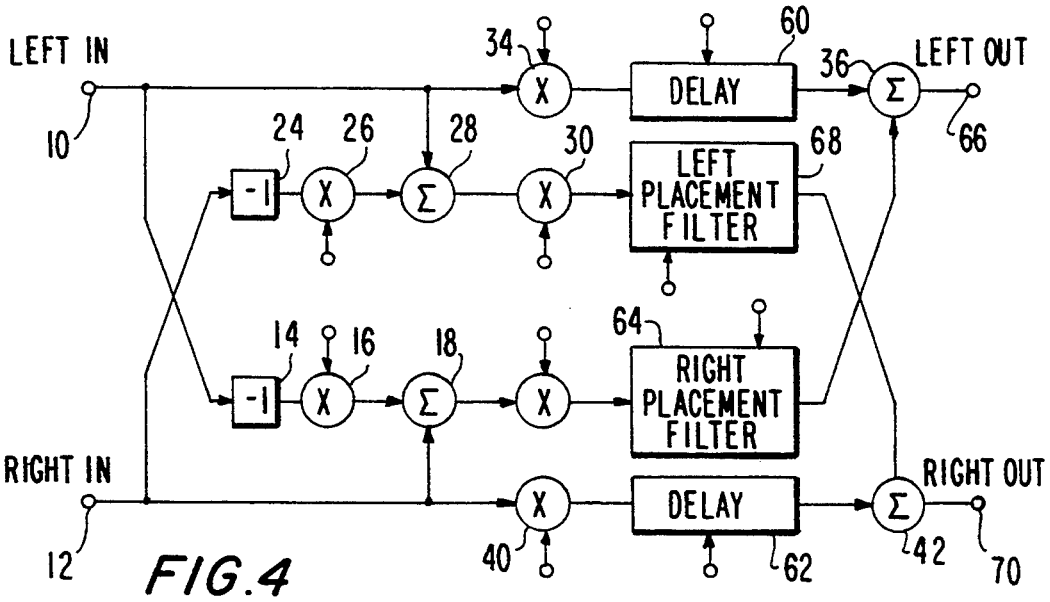
FIG. 4 is a schematic in block diagram form showing the system of FIG. 1 in more detail.

In the embodiment of FIG. 3 all of the attenuators, invertors, and the like, as well as the left and right placement filters require a finite length of time to perform their various functions. Therefore, in order to have the entire system be correctly timed, delay units in the left and right channels can be provided. Specifically, as shown in FIG. 4 the output of the attenuator 34 is fed to a controllable delay unit 60 and the output of the variable attenuator 40, which represents the right channel, is fed to another controllable delay unit 62. The extent of the delay to be imparted can be either preset, in which case the control terminals to the delay units would have a constant fed in or it can be controllable such as by a microprocessor or the like to achieve various different stereo effects. In each event, however, the output of delay unit 60 is fed as one input to the signal summing circuit 36 and the other input to signal summer 36 is the output of the right-placement filter 64. This right-placement filter 64 can also be a controllable filter, in which either the control input is a constant, in which case the filter effect is fixed, or the control input can be a variable as controlled by a microprocessor or some other programmed source. In each event, the output of the right-placement filter 64 becomes the second input to the signal summer 36 whose output then is the left-channel output appearing at terminal 66. Similarly, the output of the controllable delay 62 is fed as one input to signal summer 42 whose other output is derived from the controllable left- placement filter 63. That filter may be controlled by either a constant or variable value and the leftplacement filter output signal is fed as the second output to the signal summer 42, whose output is fed out as the right-channel output on terminal 70.

By providing controllable left and right placement filters 64 and 68, this means that the transfer function of the overall filter can be controlled. Such control may be user selectable, for example, to optimize the stereo enhancer for different speaker geometries or to adjust the center of the image focusing to the optimum listening position.

Although in the embodiments of FIGS. 3 and 4 all of the left and right placement filtering is shown as taking place in respective left and right placement filers, it should be understood that the filtering operations can be distributed between both signal paths for each left and right channel. The placement filtering operation provides a phase and amplitude differential between the signal paths of a channel. That differential need not be achieved using only a single placement filter in one signal path and a filter in each signal path of a channel could also be advantageously employed. Thus, in the embodiment of FIG. 4 the controllable delay filters 60 and 62 could be replaced by complementary placement filters.

Figure 5:
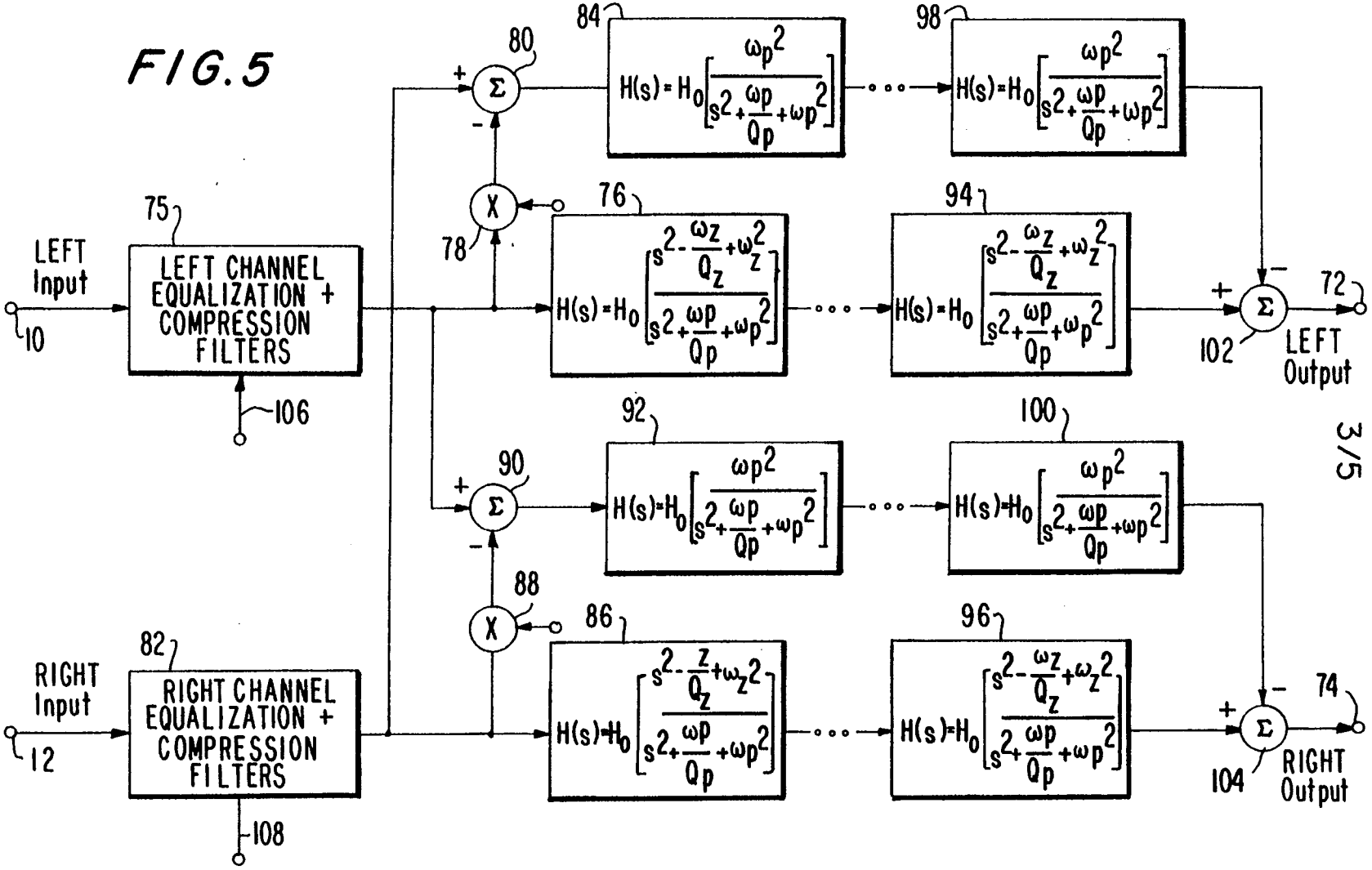
FIG. 5 is a schematic in block diagram form of another embodiment of the stereo enhancement system of the present invention.

FIG. 5 represents an embodiment of the present invention in which the filters are generalized and the signal inversion takes place by way of subtracting the two channel signals in lieu of inverting one channel and adding the two channels. More specifically, as shown in FIG. 5, the left and right stereo input signals are provided at terminals 10 and 12 and represent line level signals of approximately one volt RMS. The filters in the system of FIG. 5 are adjusted so that the output signals at terminals 72 and 74 are also typically the same nominal level of one volt RMS.

The filtering in the embodiment of FIG. 5 consists of two sets of filters that perform amplitude and phase alterations on a predetermined frequency dependent basis on the original stereo signals to produce the enhanced stereo sound field, resulting in the illusion of sound images outside the extreme loudspeaker positions.

These filters can be embodied as continuous time filters, that is, the signal is not sampled but is continuously filtered. On the other hand, the filters could just as well be embodied as discretely sampled filters employing switched capacitor structures. There are provided two filters for each channel, one filter provides a time delay for the input signal and the other filter provides amplitude and phase processing to the signal, which processed signal is then subtracted from the time delayed signal in the other channel. More specifically, input signals appearing at the left channel input terminal 10 may be fed through a left channel equalization and compression filter 75, which will be described hereinbelow. The output signal of the equalization and compression filter 75 is then fed directly to a left channel delay filter stage 76. That output signal from the left channel equalization and compression filter 75 is also fed to a controllable attenuator 78, whose output is fed to the minus input of a signal subtracting circuit 80. The other input to the signal subtracting circuit 80, which is fed in at the positive input, is derived at the output of a right channel equalization and compression filter 82, whose input is the right channel stereo signal fed in at input terminal 12. The output of the signal subtracting circuit 80 is fed to a right amplitude filter stage 84. The attenuator 78 can be controllable by having a fixed constant fed in at its control input or by a variable signal under control of the user, for example. The equalization and compression filters may also be referred to an equalization and compression filters.

The signal for the right channel after having been passed through the right-channel equalization and compression filter 82 is directly fed to a right delay filter stage 86 and is also fed to a controllable attenuator 88, whose output is fed to the subtraction or minus input of a signal subtracting circuit 90. The other input to the signal subtracting circuit 90 that is fed to the positive or addition input is derived as the output from the left-channel equalization and compression filter 75. Thus, the output of the subtractor circuit 90 represents the difference between the left channel and the right channel and is fed to the left amplitude filter stage 92.

The time delay filters can be implemented as a cascaded series of all-pass bi-quadratic filter stages. These additional delay stages following the left-channel delay filter stage 76 are represented at 94. The additional right-channel delay filters stages following delay filter 86 are represented at 96. The bi-quadratic structure is a particularly advantageous analog filter and is frequently used because of its low sensitivity to component value variations. Nevertheless, other filter implementations realizing the desired transfer function may be used as well.

The left and right amplitude filter stages 84 and 92 can be implemented as a cascaded series of low-pass biquadratic filter stages having various filter quality factors (Q) and center frequencies. Thus, the right amplitude filter stage 84 consists of a number of stages in cascade, as represented by the right amplitude filter stage 98. Similarly, the left amplitude filter stage 92 is one of a cascaded series of filters, as represented by the left amplitude filter stage 100.

The enhanced stereo outputs are derived from the original stereo input signals having been delayed and with all common information being passed through without processing. Specifically, the left-channel delay filter 94 provides the output fed to a positive input of a signal subtracting circuit 102, with the negative or minus input being derived from the right amplitude filter stage 98. The output of subtracting circuit 102 appears at terminal 72 as the left-channel output. Similarly, the right-channel signal that has been delayed is fed through the last delay filter stage 96 to the positive input of signal subtracting circuit 104 whose minus input is derived from the last stage 100 of the left amplitude filter and the output of the signal subtracting circuit 104 is available as the right-channel output signal at terminal 74.

The filter transfer functions for both the placement amplitude adjusting filters and the delay filters are set forth in the appropriate blocks in the embodiment of FIG. 5. As is well-known, the Laplace transform polynomial can be expressed as a product of a series of smaller polynomials, limited to a maximum degree of two in both the numerator and denominator. Such a polynomial is often referred to as being bi-quadratic, because it represents two quadratic equations, one in the numerator and the other in the denominator.

The bi-quadratic equation parameters can be described in terms of filter quality factors and filter center frequencies, represented respectively as Q and $\omega$ in the filters in FIG. 5. The terms in the denominator of the transfer functions shown in filters of the embodiment of FIG. 5 represent poles in the S domain and the terms in the numerator of the bi-quadratic equation of the transfer function represent zeros. Poles and zeros represent the roots of the quadratic terms in the numerator and the denominator and, in general, occur in complex conjugate pairs. Thus, each filter stage may represent a pole pair or a pole and zero pair depending upon the requirements for the filter.

It should be understood, of course, that the filter transfer function can be realized using the so-called direct form filter implementation, in which the overall filter transfer function is described by the original approximate transfer function polynomial which is not factored into bi-quadratic elements.

Moreover, the embodiments of the present invention as described above are equally applicable to digital implementation, in which case the filters might be embodied by finite impulse response filters (FIRs) or by infinite impulse response filters (IIRs).

The inventors have found through experimentation that sets of eight-pole filters provide acceptable stereophonic images quality, whereas sets of filters with fewer numbers of poles do not provide acceptable imaging. On the other hand, twelve-pole filters have been found to provide some improvement over the eight-pole filters but not enough to warrant the additional cost.

The actual transfer function values may be obtained empirically and represent the best match to the empirically derived transfer function that will provide an enhanced audio image relative to the cost of the additional filter stages.

The range of Q circuit factors encountered in the various filters stages varies from as low as 0.3 to as high as 10. Similarly, the range of filter center frequencies varies from a low of 200 Hz to 16000 Hz. The filters are intended to be unity gain systems and are not intended to provide any increase or decrease in the net signal energy for typical audio signals. The filter circuits should perform to a noise figure of approximately 60 db, that is, a signal plus noise to noise ratio of 60 db is the lowest acceptable noise limit for general audio applications for filters such as these.

Figure 6A:
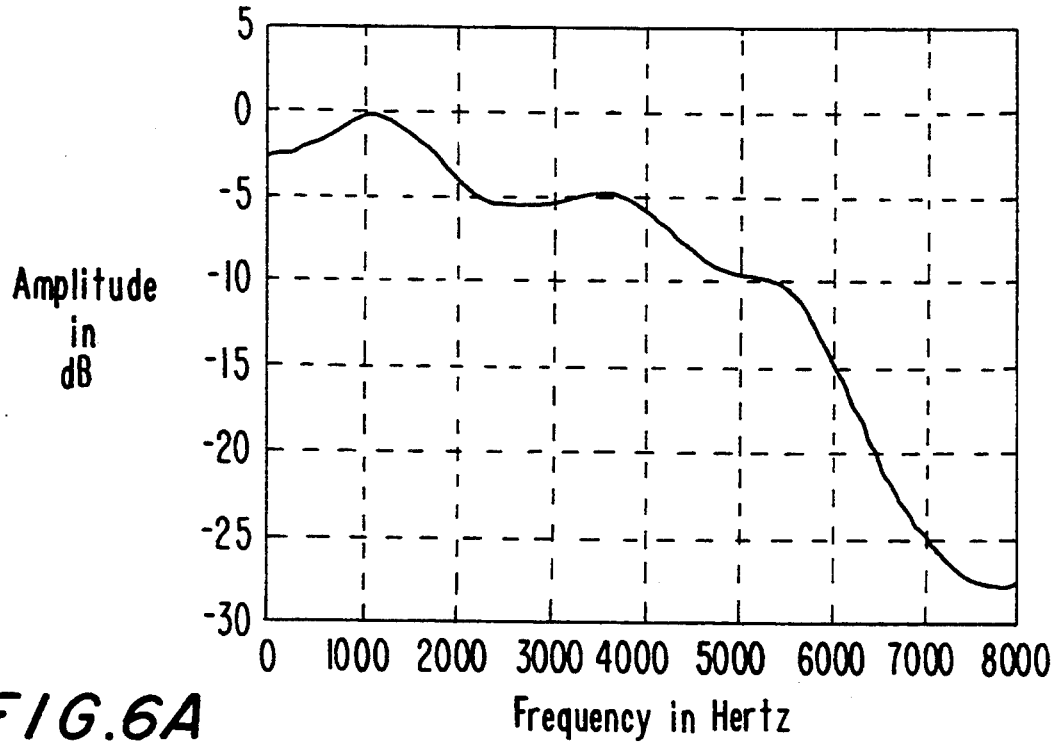
FIGS. 6A and 6B are typical filter transfer functions of the filters found in the system of FIG. 5.
Figure 6B:
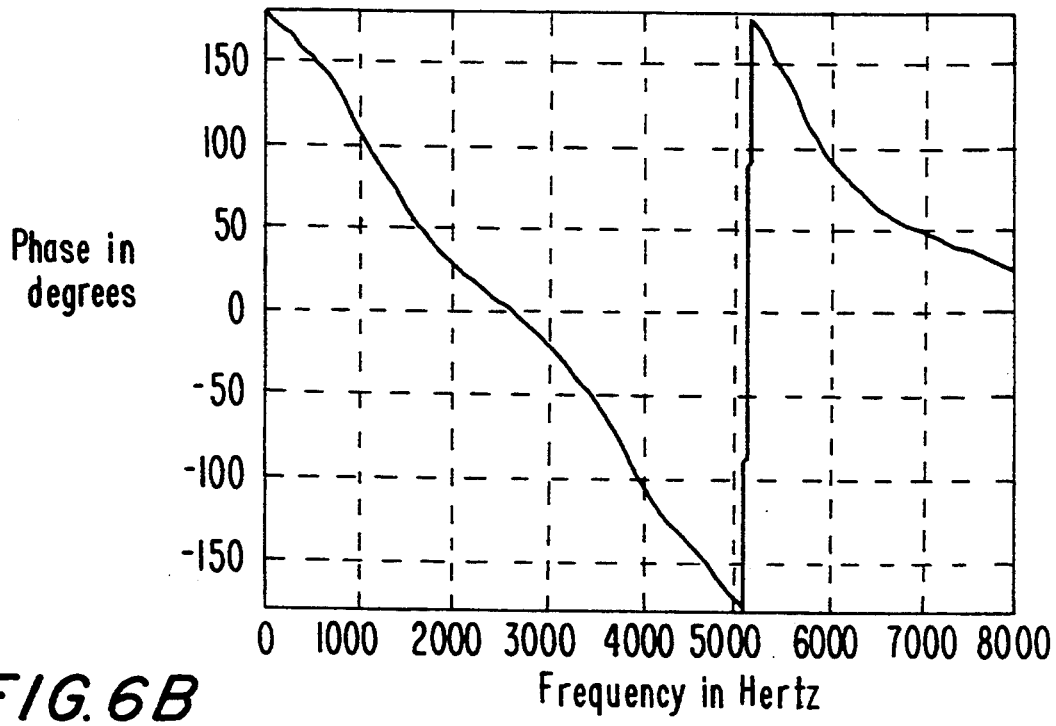

In regard to the transfer functions employed in the filters of FIG. 5, FIG. 6A shows a typical right amplitude filter transfer function plotted as amplitude versus frequency, such as might be implemented the right placement filter shown at 84 in FIG. 5. While the typical left amplitude filter 92 would not be identical to that shown in FIG. 4A, the transfer function is generally of the same class. On the other hand, FIG. 6B shows a typical right placement filter transfer function plotted as phase versus frequency, such as might be implemented by the right placement filter stage 84. The left filter stage 92 would have the same general kind of phase transfer function as that shown in FIG. 6B.

Figure 7:
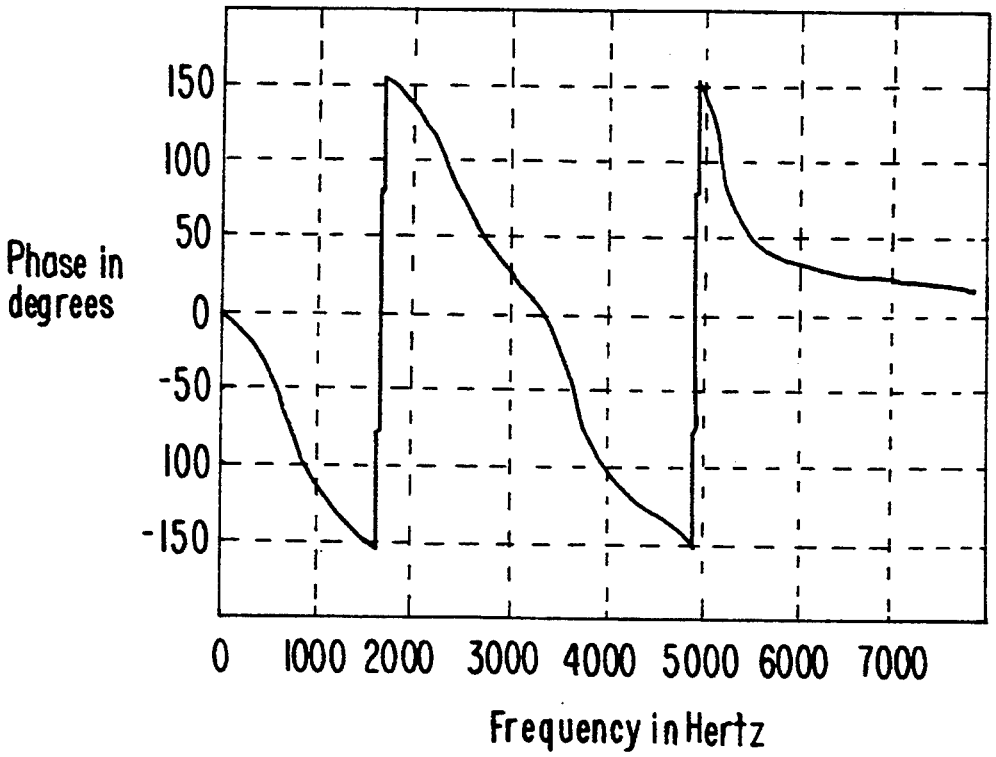
FIG. 7 is a typical delay function of the delay filters used in the system of FIG. 5.

FIG. 7 represents a typical left filter delay function plotted as phase versus frequency as might be present in the left delay filter stage 76. The right delay filter stage 86 would have a phase versus frequency response along the same lines but not being identical to that shown in FIG. 7.

It has been determined by the inventors that utilizing the filter network as shown in FIG. 5 results in some loss of low frequency energy from the original source material. Thus, front end processing can be optimally applied to the input signals, with such processing being represented by the left-channel equalization and compression filter 75 and the right-channel equalization and compression filter 82.

Alternatively, in order to restore the lower frequency energy a portion of the opposite channel signal can be subtracted from the input to the phase and amplitude placement filters and this has been shown in listening tests to effectively restore some of the low frequency energy without adversely affecting image quality. This approach is not represented in the embodiment of FIG. 5.

On the other hand, the other approach for front end processing consists of the bass boost filters, such as 75 and 82, which can be applied to each signal before it is processed by the filter circuitry. The left-channel equalization and right-channel equalization as provided respectively by the filters 75 and 82 can provide additional gain for selected frequencies. Another approach that can be implemented with the filters 75 and 82 is to provide semilogarithmic dynamic range compression for the signals prior to being fed to the filters. Such dynamic range compression would reduce the amplitude of the peak values and increase the amplitude of the lower values in the source material so to provide a lower overall dynamic range in the output signals. The inventors have conducted listening tests that indicate that the compressed signal material should be readily acceptable to a wider audience than noncompressed signal material and may reduce offensiveness of source material amplitude variations. Furthermore, the equalization and compression filters can be individually controllable, as represented at 106 and 108, by the user of the apparatus or by a programmed control system to adjust the various equalization values and the extent of compression.

The above description is based on preferred embodiments of the present invention, however, it will apparent that modifications and variations thereof could be effected by one with skill in the art without departing from the spirit or scope of the invention, which is to be determined by the following claims.

What is claimed is:

1. Stereo sound field enhancement apparatus for use in reproducing left and right stereophonic audio signals in a system employing left and right placement filters that alter the phase and amplitude of the signals on a predetermined frequency dependent basis, the apparatus comprising:

first means receiving the left and right stereophonic audio signals for producing a left output signal from which substantially all audio information common to the right stereophonic audio signal is removed, said left output signal being fed to the right placement filter, and for producing a right output signal from which substantially all audio information common to the left stereophonic audio signal is removed, said right output signal being fed to the left placement filter;

combining means for combining an output of the left placement filter and the right stereophonic audio signal to form an enhanced right-channel stereo signal and for combining an output of the right placement filter and the left audio signal to form an enhanced left-channel stereo signal; and a left-channel delay unit for delaying the left stereophonic audio signal fed to said combining means for combining with an output of said right placement filter, and a right-channel delay unit for delaying the right stereophonic audio signal fed to said combining means for combining with an output of said left placement filter.

2. A stereo sound field enhancement apparatus according to claim 1, wherein said means for producing left and right output signals comprises a first inverter for inverting the left stereophonic audio signal and a first signal summing circuit receiving an inverted left stereophonic output signal from the first inverter and the right stereophonic audio signal for producing said right output signal; and a second inverter for inverting the right stereophonic audio signal and a second signal summing circuit receiving an inverted right stereophonic output signal from the second inverter and the left stereophonic audio signal for producing said left output signal.

3. A stereo sound field enhancement apparatus according to claim 2, wherein said means for producing left and right output signals further comprises a first controllable attenuator connected between said first inverter and said first signal summing circuit, and a second controllable attenuator connected between said second inverter and said second signal summing circuit.

4. A stereo sound field enhancement apparatus according to claim 3, further comprising third and fourth controllable attenuators receiving respectively said left and right output signals and producing attenuated signal respectively fed to the right and left placement filters.

5. A stereo sound field enhancement apparatus according to claim 4, further comprising fifth and sixth controllable attenuators receiving respectively the left and right stereophonic audio signals for producing attenuated left and right stereophonic audio signals fed to said combining means for combining respectively with said right output signal and said left output signal.

6. A stereo sound field enhancement apparatus according to claim 1, further comprising a left-channel equalization and compression filter receiving the left stereophonic audio signal for producing a filtered left-channel signal fed to said first means and said means for combining, and a right-channel equalization and compression filter receiving the right stereophonic audio signal for producing a filtered right-channel signal fed to said first means and said means for combining.

7. A stereo sound field enhancement apparatus according to claim 1, further comprising a left-channel controllable attenuator receiving the left stereophonic audio signal and producing a left-channel attenuated signal fed to said left-channel delay unit, and a right-channel controllable attenuator receiving the right stereophonic audio signal and producing a right-channel attenuated signal fed to said right-channel delay unit.

8. Stereo sound field enhancement apparatus for use in reproducing left and right stereophonic audio signals, the apparatus comprising:

left and right placement filters that alter the phase and amplitude of signals fed thereto on a predetermined frequency dependent basis;

first means receiving the left and right stereophonic audio signals for producing a left output signal from which substantially all audio information common to the right stereophonic audio signal is removed, said left output signal being fed to said right placement filter, and for producing a right output signal from which substantially all audio information common to the left stereophonic audio signal is removed, said right output signal being fed to said left placement filter;

combining means for combining an output of said left placement filter and the right stereophonic audio signal to form an enhanced right-channel stereo signal and for combining an output of said right placement filter and the left audio signal to form an enhanced left-channel stereo signal; and a left-channel delay unit for delaying the left stereophonic audio signal fed to said combining means for combining with an output of said right placement filter, and a right-channel delay unit for delaying the right stereophonic audio signal fed to said combining means for combining with an output of said left placement filter.

9. A stereo sound field enhancement apparatus according to claim 8, wherein said means for producing left and right output signals comprises a first inverter for inverting the left stereophonic audio signal and a first signal summing circuit receiving an inverted left stereophonic output signal from the first inverter and the right stereophonic audio signal for producing said right output signal; and a second inverter for inverting the right stereophonic audio signal and a second signal summing circuit receiving an inverted right stereophonic output signal from the second inverter and the left stereophonic audio signal for producing said left output signal.

10. A stereo sound field enhancement apparatus according to claim 9, wherein said means for producing left and right output signals further comprises a first controllable attenuator connected between said first inverter and said first signal summing circuit, and a second controllable attenuator connected between said second inverter and said second signal summing circuit.

11. A stereo sound field enhancement apparatus according to claim 10, further comprising third and fourth controllable attenuators receiving respectively said left and right output signals and producing attenuated signal respectively fed to said right and left placement filters.

12. A stereo sound field enhancement apparatus according to claim 11, further comprising fifth and sixth controllable attenuators receiving respectively the left and right stereophonic audio signals for producing attenuated left and right stereophonic audio signals fed to said combining means respectively with said right output signal and said left output signal.

13. A stereo sound field enhancement apparatus according to claim 8, further comprising a left-channel controllable attenuator receiving the left stereophonic audio signal and producing a left-channel attenuated signal fed to said left-channel delay unit, and a right-channel controllable attenuator receiving the right stereophonic audio signal and producing a right-channel attenuated signal fed to said right-channel delay unit.

14. A stereo sound field enhancement apparatus according to claim 8, further comprising a left-channel equalization and compression filter receiving the left stereophonic audio signal for producing a filtered left-channel signal fed to said first means and said means for combining, and a right-channel equalization and compression filter receiving the right stereophonic audio signal for producing a filtered right-channel signal fed to said first means and said means for combining.

* * * * *

UNITED STATES PATENT AND TRADEMARK OFFICE

CERTIFICATE OF CORRECTION

PATENT NO. : 5,440,638

DATED : August 8, 1995

INVENTOR(S) : Danny D. Lowe; Scott Willing; William Gonnason; Mark Williams

It is certified that error appears in the above-indentified patent and that said Letters Patent is hereby corrected as shown below:

Column 8, Line 10, delete the first occurrence of "right" and insert therefor -- left --.

Column 8, Line 14, delete "left" and insert therefor -- right --.

Column 9, Line 20, delete the first occurrence of "right" and insert therefor -- left --.

Column 9, Line 24, delete "left" and insert therefor -- right --.

Signed and Sealed this

Twenty-fourth Day of June, 1997

Bruce Lehman

*Attest:*

BRUCE LEHMAN

*Attesting Officer*

*Commissioner of Patents and Trademarks*